US009389004B1

(12) United States Patent
Foster et al.

(10) Patent No.: US 9,389,004 B1
(45) Date of Patent: Jul. 12, 2016

(54) CAVITATION HEATER SYSTEM

(76) Inventors: John R. Foster, Searsmont, ME (US); Ronald Burton Manwell, Winthrop, ME (US)

( * ) Notice: Subject to any disclaimer, the term of this patent is extended or adjusted under 35 U.S.C. 154(b) by 449 days.

(21) Appl. No.: 12/931,416

(22) Filed: Feb. 1, 2011

Related U.S. Application Data

(60) Provisional application No. 61/337,203, filed on Feb. 1, 2010.

(51) Int. Cl.
*F24H 1/00* (2006.01)
*F24J 3/00* (2006.01)

(52) U.S. Cl.
CPC ..... *F24J 3/003* (2013.01)

(58) Field of Classification Search
USPC ..... 122/26; 126/247; 237/8 A, 8 R, 12.3 B, 237/12.3 R, 19, 34
See application file for complete search history.

(56) References Cited

U.S. PATENT DOCUMENTS

| | | | | |
|---|---|---|---|---|
| 4,143,639 | A * | 3/1979 | Frenette | 126/247 |
| 4,325,354 | A * | 4/1982 | Fuchs | 126/247 |
| 5,899,173 | A * | 5/1999 | Okabe et al. | 122/26 |
| 5,906,177 | A * | 5/1999 | Okabe et al. | 122/26 |
| 7,647,896 | B2 * | 1/2010 | Isopo | 122/26 |
| 7,969,263 | B2 * | 6/2011 | Sturgis et al. | 335/135 |

* cited by examiner

*Primary Examiner* — Steven B McAllister
*Assistant Examiner* — Ko-Wei Lin

(57) ABSTRACT

Cylindrical interior and exterior drums, each drum has a cylindrical side wall with primary and secondary end caps. Fixed primary and secondary supports are provided. Each support has a primary shaft with an interior end fixedly supported by a primary end cap of an interior drum and an exterior end rotatably supported in a support plate. A drive disc is secured to the primary shaft for rotation therewith. The drive disc has an angled exterior surface. The primary end cap of the exterior drum has an angled interior surface. A plurality of cones are in contact with the interior and exterior surfaces whereby rotation of the drive disc and the primary shaft and the interior drum will translate into counter rotation of the exterior drum. A quantity of fluid is located between the drums for generating heat in response to the counter rotation of the drums.

8 Claims, 7 Drawing Sheets

FIG 2
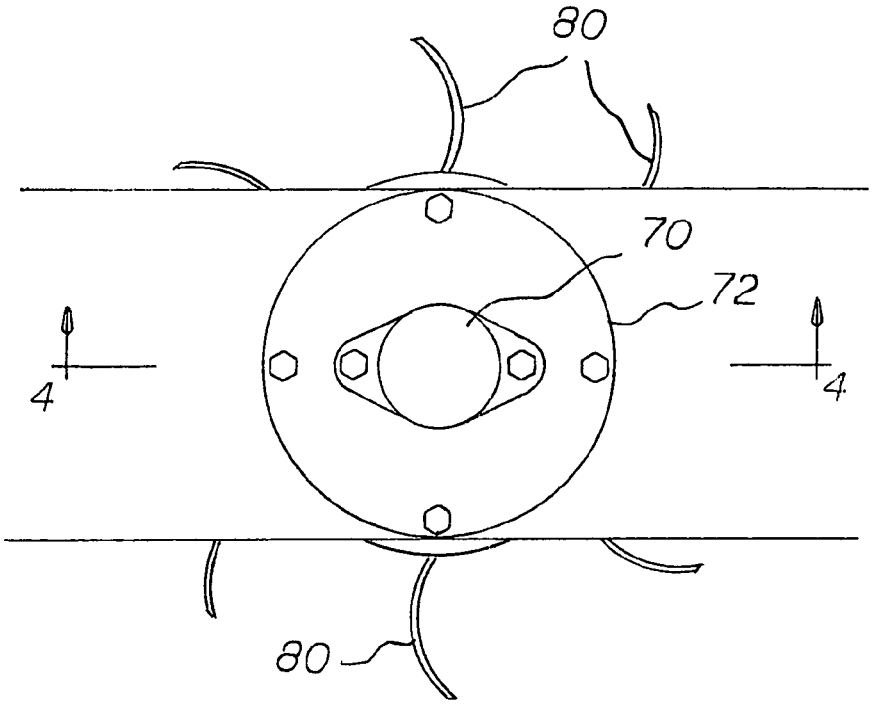
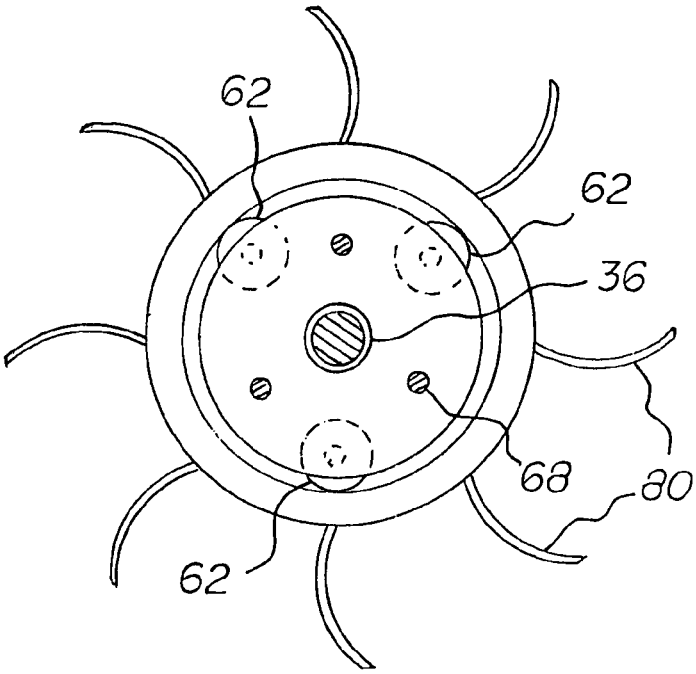
FIG 3

FIG 4
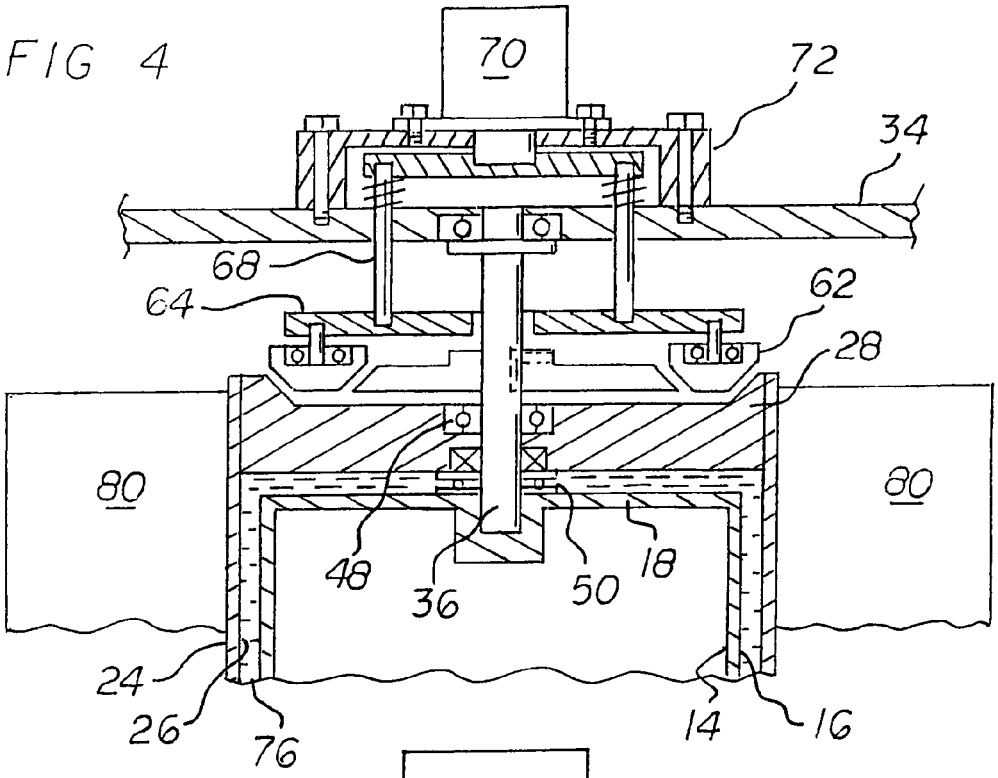
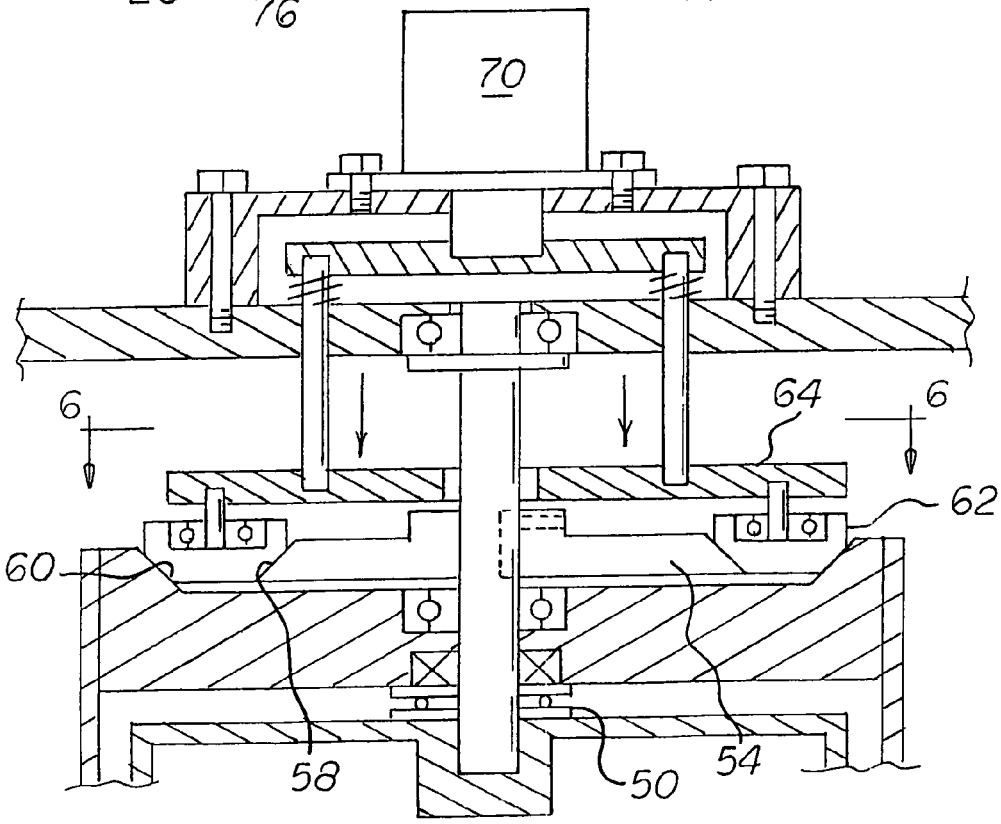
FIG 5

FIG 6
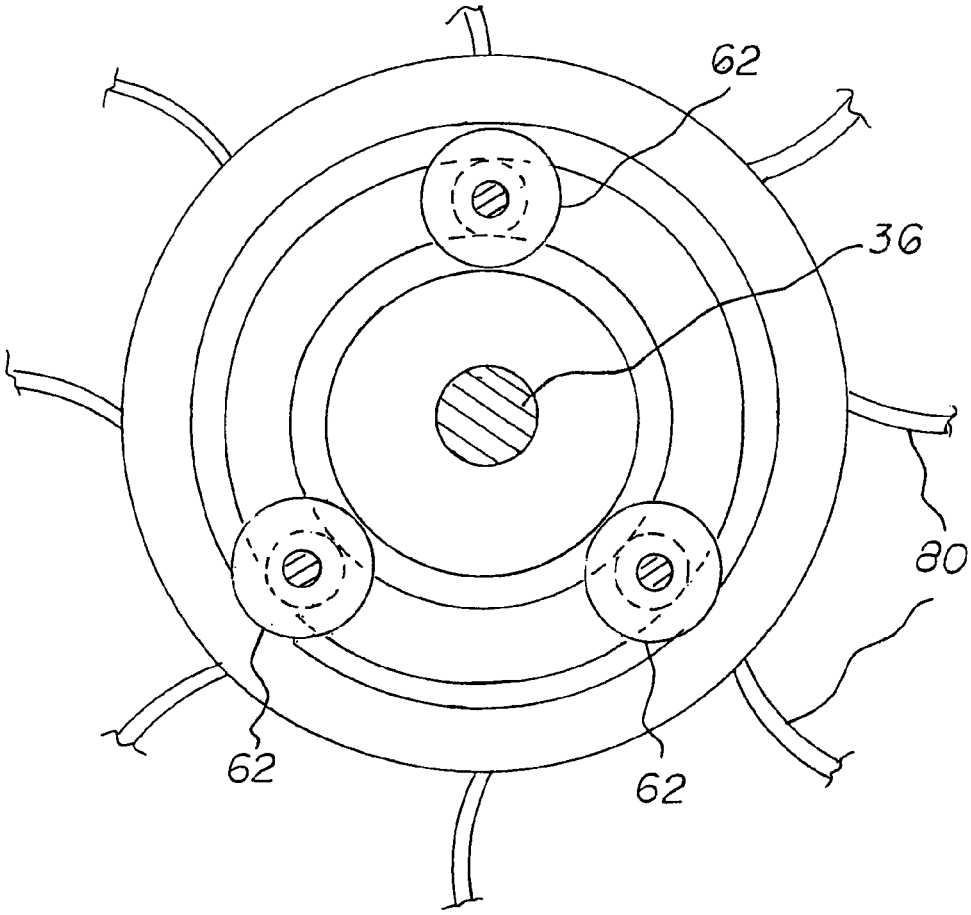
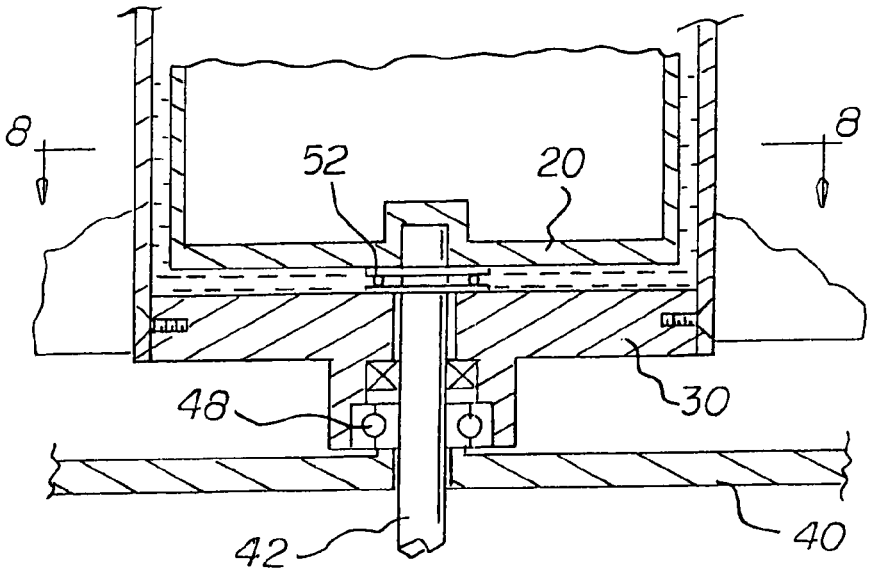
FIG 7

FIG 8
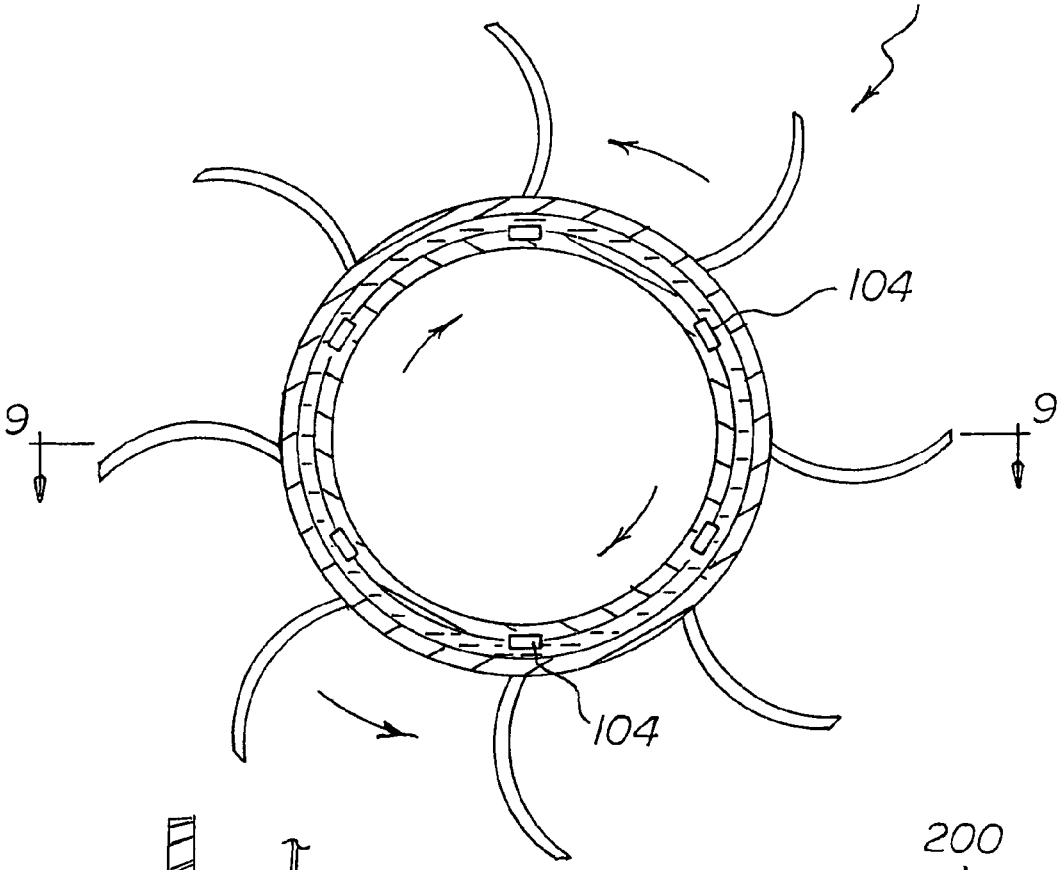
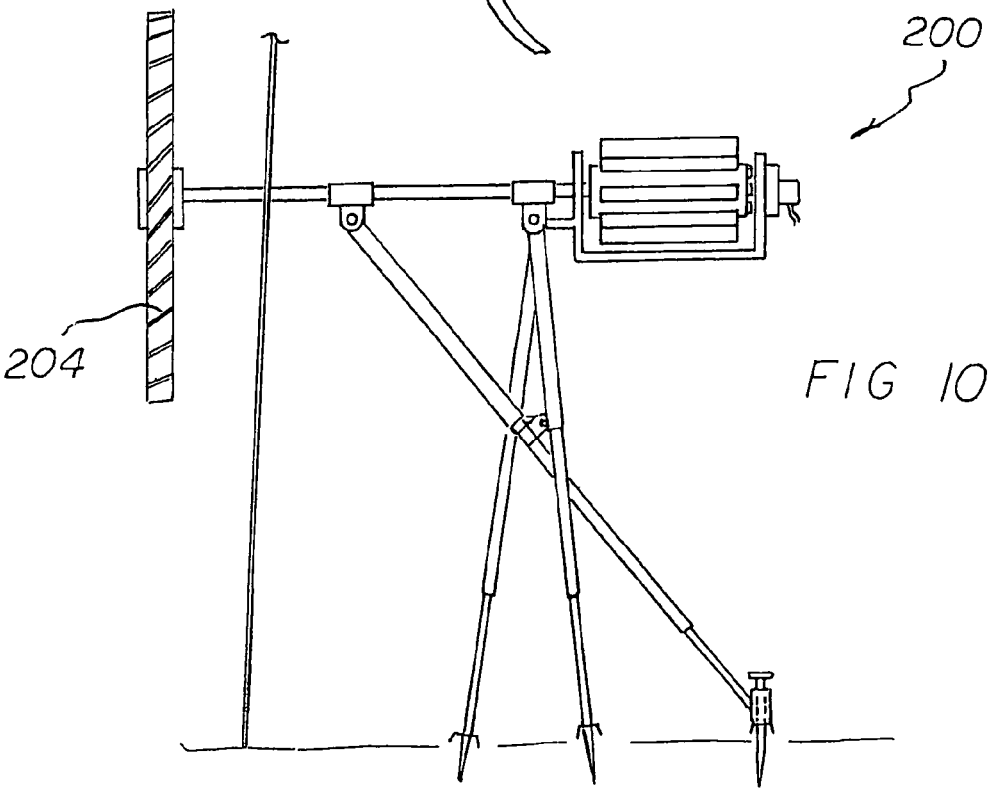
FIG 10

FIG 11
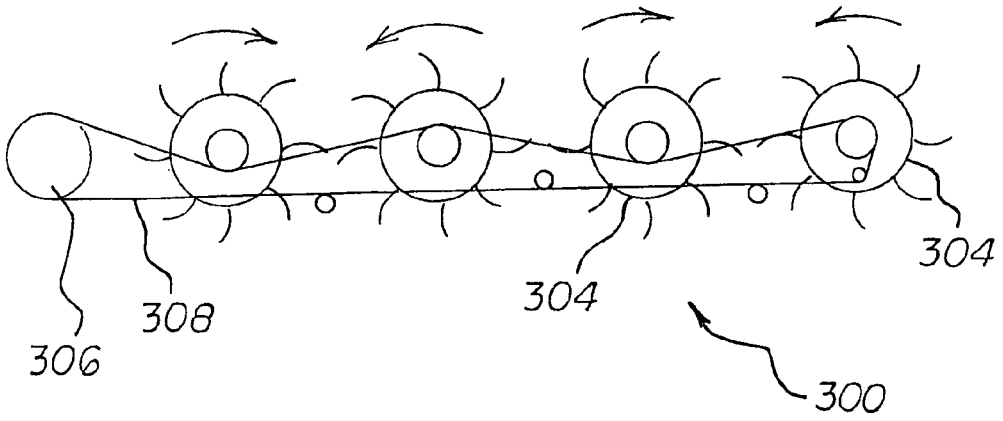
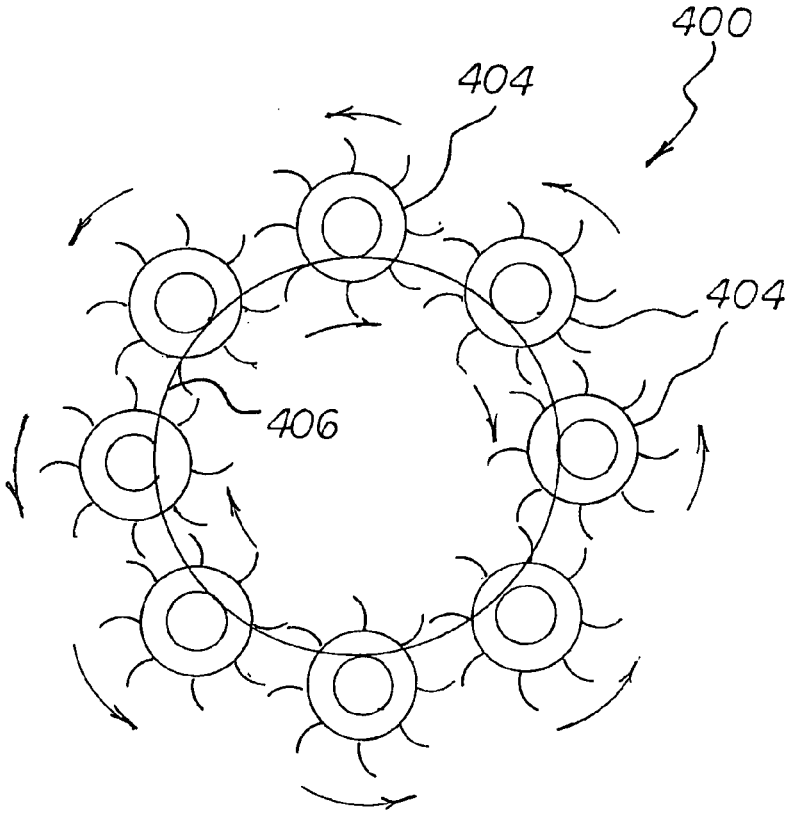
FIG 12

CAVITATION HEATER SYSTEM

RELATED APPLICATION

This application is based upon Provisional Application Ser. No. 61/337,203 filed Feb. 1, 2010 the subject matter of which is incorporated herein by reference.

BACKGROUND OF THE INVENTION

1. Field of the Invention

The present invention relates to a cavitation heater system and more particularly pertains to generating heat through the movement of oil caused by the counter rotating movement of cylindrical drums.

2. Description of the Prior Art

The use of space heaters of known designs and configurations is known in the prior art. More specifically, space heaters of known designs and configurations previously devised and utilized for the purpose of generating heat are known to consist basically of familiar, expected, and obvious structural configurations, notwithstanding the myriad of designs encompassed by the crowded prior art which has been developed for the fulfillment of countless objectives and requirements. By way of example, U.S. Pat. No. 4,143,639 issued Mar. 13, 1979 to Frenette relates to a Friction Heat Space Heater.

While the prior art devices fulfill their respective, particular objectives and requirements, they do not describe a cavitation heater system that allows generating heat through the movement of oil caused by the counter rotating movement of cylindrical drums.

In this respect, the cavitation heater system according to the present invention substantially departs from the conventional concepts and designs of the prior art, and in doing so provides an apparatus primarily developed for the purpose of generating heat through the movement of oil caused by the counter rotating movement of cylindrical drums.

Therefore, it can be appreciated that there exists a continuing need for a new and improved cavitation heater system which can be used for generating heat through the movement of oil caused by the counter rotating movement of cylindrical drums. In this regard, the present invention substantially fulfills this need.

SUMMARY OF THE INVENTION

In view of the disadvantages inherent in the known types of space heaters of known designs and configurations now present in the prior art, the present invention provides an improved cavitation heater system. As such, the general purpose of the present invention, which will be described subsequently in greater detail, is to provide a new and improved cavitation heater system and method which has all the advantages of the prior art and none of the disadvantages.

To attain this, the present invention essentially comprises a cylindrical interior drum having a cylindrical side wall with primary and secondary end caps. The interior drum has a first diameter and a first axial length.

Next provided is a cylindrical exterior drum, having a cylindrical side wall with primary and secondary end caps. The exterior drum has a second diameter greater than the first diameter. The exterior drum has a second axial length greater than the first axial length.

A fixed primary support plate is next provided. A primary shaft is also provided having an interior end fixedly supported by the primary end cap of the interior drum. The primary shaft has an exterior end rotatably supported in the primary support plate.

Next a fixed secondary support plate is provided. A secondary shaft is also provided having an interior end fixedly supported by the secondary end cap of the interior drum. The secondary shaft has an exterior end rotatably supported in the secondary support plate.

Roller bearings are next provided. The roller bearings are positioned between the primary shaft and the primary end cap of the exterior drum and between the secondary shaft and the secondary end cap of the exterior drum. Thrust bearings encompass the primary shaft between the primary end cap of the interior drum and the primary end cap of the exterior drum. In addition, thrust bearings encompass the secondary shaft between the secondary end cap of the interior drum and the secondary end cap of the exterior drum.

Next, a drive disc is provided. The drive disc is secured to the primary shaft for rotation therewith. The drive disc is adapted to be operatively coupled to a source of power. The source of power is not shown in the drawings.

The drive disc has an angled exterior surface. The primary end cap of the exterior drum has an angled interior surface facing the exterior surface of the drive disc to create an annular chamber. A plurality of elastomeric cones in the chamber are in contact with the interior surface and exterior surface. In this manner, rotation of the drive disc and the primary shaft and the interior drum will translate into counter rotation of the exterior drum. A cone retaining plate supports the plurality of cones for rotational movement. The drive disc and the drums have a common vertically oriented central axis.

Next, a plurality of guide pins are provided. The guide pins extend through the primary support plate and are axially shiftable with respect thereto. Each of the guide pins has an interior end secured to the cone retaining plate. The guide pins have exterior ends with a solenoid plate receiving and supporting the exterior ends of the guide pins. A linear solenoid is secured to the solenoid plate for axial movement of the guide pins and cones for initiating and terminating the rotation and counter rotation of the drums. A retention assembly is provided for positioning the solenoid at a fixed distance from the primary support plate.

A quantity of oil is located between the interior and exterior drums. Oil is the preferred fluid. It should be understood, however, that alternative fluids may be utilized in the system. In this manner, heat is generated in response to the counter rotation of the drums.

Lastly, fins are provided. The fins are secured to and extend radially outwardly from the exterior drum. The fins function to dissipate heat generated by the oil. The fins are arcuately shaped as air moving blades.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention.

It is important, therefore, that the invention be regarded as including such equivalent constructions insofar as they do not depart from the spirit and scope of the present invention.

It is therefore an object of the present invention to provide a new and improved cavitation heater system which has all of the advantages of the prior art cavitation heaters of known designs and configurations and none of the disadvantages.

It is another object of the present invention to provide a new and improved cavitation heater system which may be easily and efficiently manufactured and marketed.

It is further object of the present invention to provide a new and improved cavitation heater system which is of durable and reliable constructions.

An even further object of the present invention is to provide a new and improved cavitation heater system which is susceptible of a low cost of manufacture with regard to both materials and labor, and which accordingly is then susceptible of low prices of sale to the consuming public, thereby making such cavitation heater system economically available to the buying public.

Lastly, it is an object of the present invention to provide a new and improved cavitation heater system. The system comprises cylindrical interior and exterior drums. Each drum has a cylindrical side wall with primary and secondary end caps. Fixed primary and secondary supports are provided. Each support has a primary shaft with an interior end fixedly supported by a primary end cap of an interior drum and an exterior end rotatably supported in a support plate. A drive disc is secured to the primary shaft for rotation therewith. The drive disc has an angled exterior surface. The primary end cap of the exterior drum has an angled interior surface. A plurality of cones are in contact with the interior and exterior surfaces whereby rotation of the drive disc and the primary shaft and the interior drum will translate into counter rotation of the exterior drum. A quantity of fluid is located between the drums for generating heat in response to the counter rotation of the drums.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a plan view of the system taken along line 2-2 of FIG. 1.

FIG. 3 is a cross sectional view taken along line 3-3 of FIG. 1.

FIG. 4 is a cross sectional view of the upper portion of the system taken along line 4-4 of FIG. 2 with the system being in the inoperative orientation.

FIG. 5 is a cross sectional view of the upper portion of the system taken along line 4-4 of FIG. 2 with the system being in the operative orientation.

FIG. 6 is a cross sectional view taken along line 6-6 of FIG. 5.

FIG. 7 is a cross sectional view of the lower portion of the system taken along line 4-4 of FIG. 2.

FIG. 8 is a cross sectional view taken along line 8-8 of FIG. 7.

FIGS. 10, 11 and 12 are front elevational views of cavitation heater systems constructed in accordance with alternate embodiments of the invention.

The same reference numerals refer to the same parts throughout the various Figures.

DESCRIPTION OF THE PREFERRED EMBODIMENTS

Figure 1:
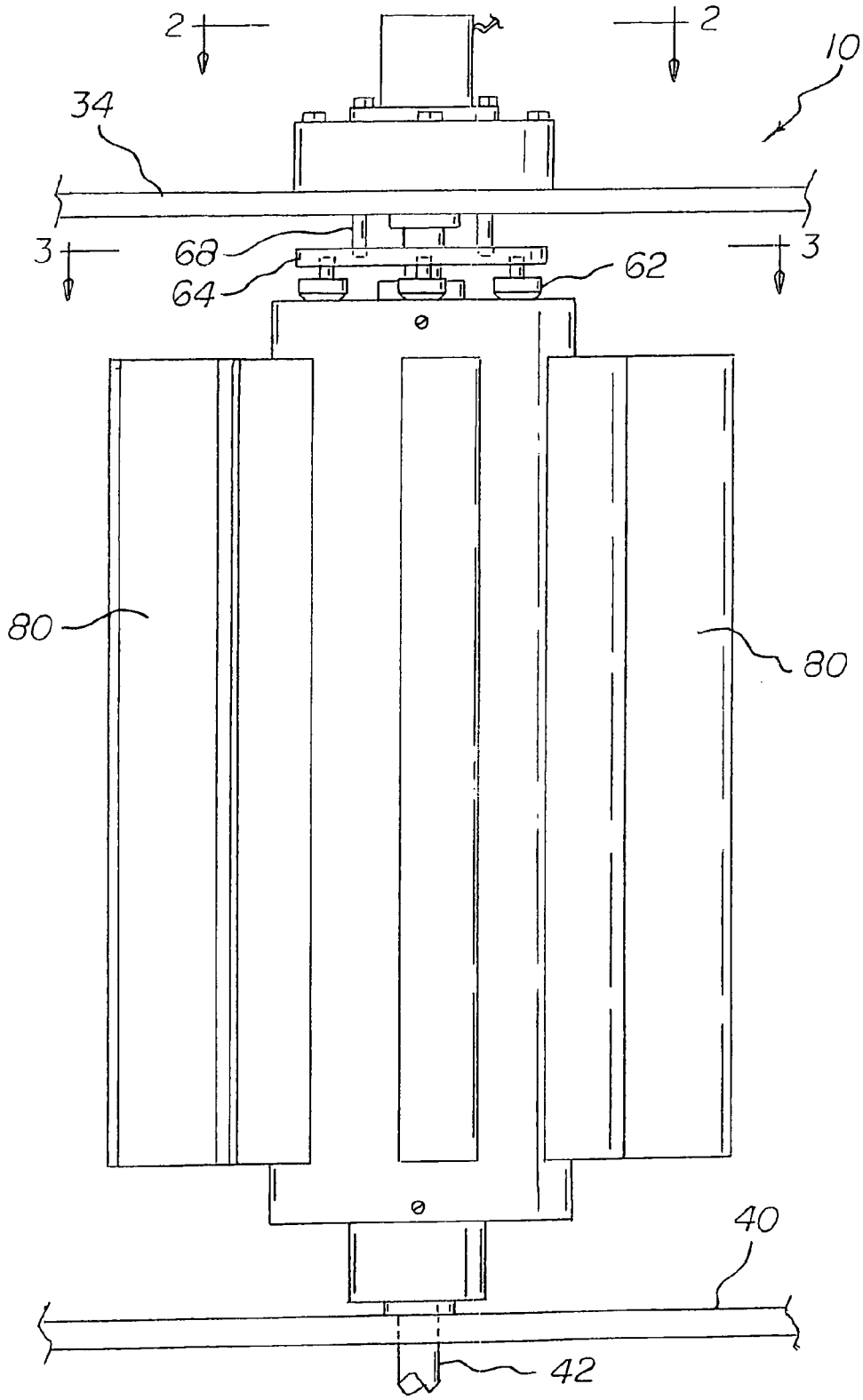
FIG. 1 is a front elevational view of a cavitation heater system constructed in accordance with the principles of the present invention.

With reference now to the drawings, and in particular to FIG. 1 thereof, the preferred embodiment of the new and improved cavitation heater system embodying the principles and concepts of the present invention and generally designated by the reference numeral 10 will be described.

The present invention, the cavitation heater system 10 is comprised of a plurality of components. Such components are individually configured and correlated with respect to each other so as to attain the desired objective. In their broadest context such components include interior and exterior drums, fixed primary and secondary supports, a drive disc, cones, and a quantity of fluid. In this broad context, first provided is a cylindrical interior drum and a cylindrical exterior drum. The drums each have a cylindrical side wall with primary and secondary end caps. A fixed primary support has a primary shaft with an interior end fixedly supported by the primary end cap of the interior drum and an exterior end rotatably supported in a support plate. A fixed secondary support has a secondary shaft with an interior end fixedly supported by the secondary end cap of the interior drum and an exterior end rotatably supported in a support plate. A drive disc is secured to the primary shaft for rotation therewith. The drive disc has an angled exterior surface. The primary end cap of the exterior drum has an angled interior surface. A plurality of cones is in contact with the interior and exterior surfaces whereby rotation of the drive disc and the primary shaft and the interior drum will translate into counter rotation of the exterior drum. A quantity of fluid is located between the drums for generating heat in response to the counter rotation of the drums.

The preferred embodiment of the cavitation heater system (10) is shown in FIGS. 1-7. The system is for generating heat through the movement of oil caused by the counter rotating movement of cylindrical drums. The movement of the. drums and the generation of the heat is effected in a safe, efficient and economical manner.

First provided is a cylindrical interior drum (14) having a cylindrical side wall (16) with primary and secondary end caps (18) (20). The interior drum having a first diameter and a first axial length.

Next provided is a cylindrical exterior drum (24) having a cylindrical side wall (26) with primary and secondary end caps (28) (30). The exterior drum has a second diameter greater than the first diameter. The exterior drum has a second axial length greater than the first axial length.

A fixed primary support plate (34) is next provided. A primary shaft (36) is also provided having an interior end fixedly supported by the primary end cap (18) of the interior drum. The primary shaft has an exterior end rotatably supported in the primary support plate.

Next a fixed secondary support plate (40) is provided. A secondary shaft (42) is also provided having an interior end fixedly supported by the secondary end cap of the interior drum (20). The secondary shaft has an exterior end rotatably supported in the secondary support plate (40).

Roller bearings (48) are next provided. The roller bearings are positioned between the primary shaft (36) and the primary end cap (28) of the exterior drum and between the secondary shaft (42) and the secondary end cap (30) of the exterior drum. Thrust bearings (50) encompass the primary shaft (36) between the primary end cap (18) of the interior drum and the primary end cap (28) of the exterior drum. In addition, thrust bearings (52) encompass the secondary shaft (42) between the secondary end cap (20) of the interior drum and the secondary end cap (30) of the exterior drum.

Next, a drive disc (54) is provided. The drive disc is secured to the primary shaft (36) for rotation therewith. The drive disc is adapted to be operatively coupled to a source of power. The source of power is not shown in the drawings.

The drive disc (54) has an angled exterior surface (58). The primary end cap (28) of the exterior drum has an angled interior surface (60) facing the exterior surface (58) of the drive disc to create an annular chamber. A plurality of elastomeric cones (62) in the chamber are in contact with the interior surface (60) and exterior surface (58). In this manner, rotation of the drive disc and the primary shaft (36) and the interior drum (14) will translate into counter rotation of the exterior drum (24). A cone retaining plate (64) supports the plurality of cones (62) for rotational movement. The drive disc (54) and the drums (14) (24) have a common vertically oriented central axis.

Next, a plurality of guide pins (68) are provided. The guide pins extend through the primary support plate (34) and are axially shiftable with respect thereto. Each of the guide pins (68) has an interior end secured to the cone retaining plate (64). The guide pins have exterior ends with a solenoid plate receiving and supporting the exterior ends of the guide pins. A linear solenoid (70) is secured to the solenoid plate for axial movement of the guide pins (68) and cones (62) for initiating and terminating the rotation and counter rotation of the drums (14) (24). A retention assembly (72) is provided for positioning the solenoid at a fixed distance from the primary support plate (34).

A quantity of oil (76) is located between the interior (14) and exterior (24) drums. Oil is the preferred fluid. It should be understood, however, that alternative fluids may be utilized in the system. In this manner, heat is generated in response to the counter rotation of the drums.

Lastly, fins (80) are provided. The fins are secured to and extend radially outwardly from the exterior drum (24). The fins function to dissipate heat generated by the oil (76) The fins are arcuately shaped as air moving blades.

Figure 9:
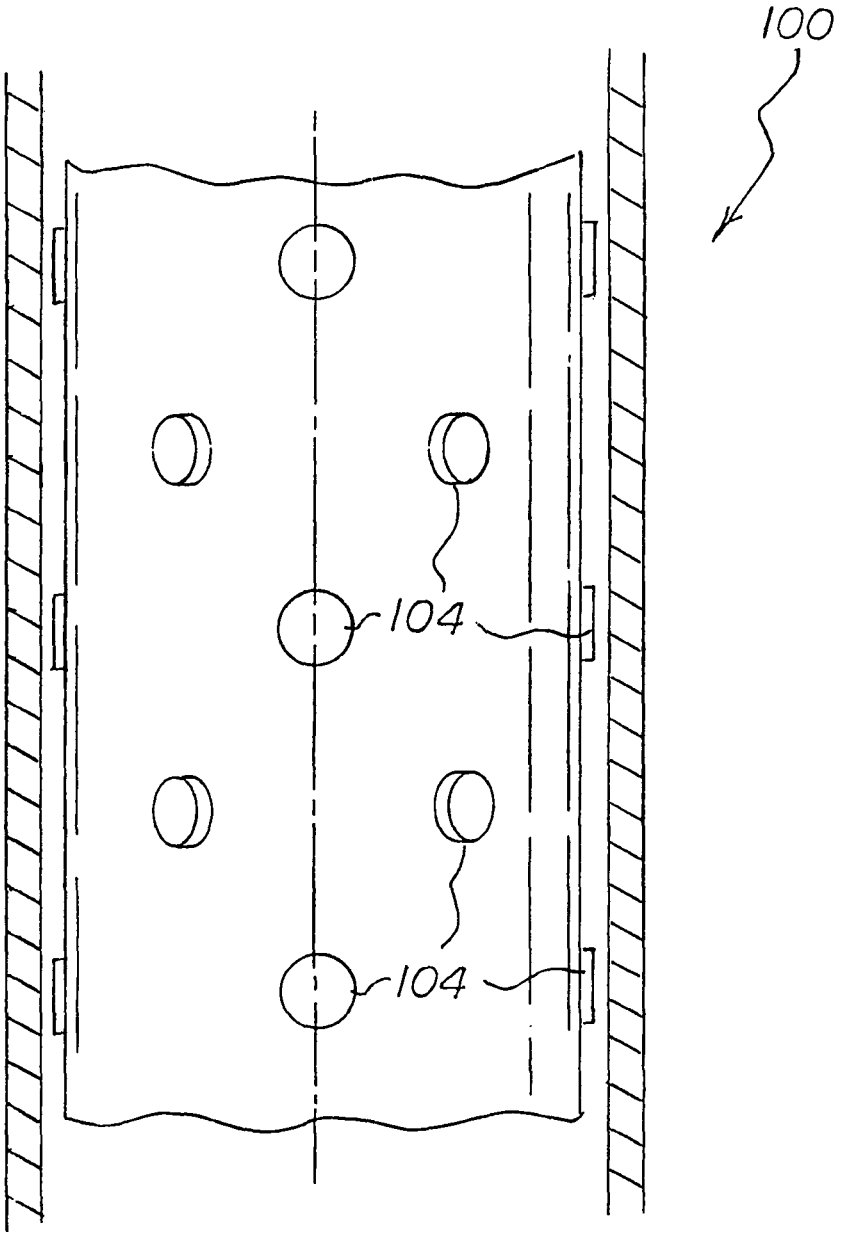
FIG. 9 is a cross sectional view taken along line 9-9 of FIG. 8.

An alternate embodiment of the system (100) is illustrated in FIGS. 8 and 9. In this embodiment, a plurality of magnets (104) is provided. The magnets are attached to and extend outwardly from one of the drums to increase the turbulence of the fluid for increasing the heating during the counter rotation of the drums. Although the magnets are illustrated as positioned to face outwardly from the interior drum, it should be understood that the magnets are adapted to be located on either the exterior drum facing inwardly or the interior drum facing outwardly. The magnets function to cause greater turbulence and heating of the fluid between the drums.

Another alternate embodiment of the system (200) is illustrated in FIG. 10. In this embodiment, the shafts and drums are all rotatable about a common horizontally oriented central axis. This embodiment further includes a propeller (204). The propeller is rotatable with the wind for rotating the primary shaft and the drums.

Still another alternate embodiment of the system (300) is illustrated in FIG. 11. In this embodiment, the system includes a plurality of sets (304) of internal and external drums. Each set has associated supports, a drive disc, cones and fluid. The drums of each set have a common axis. The axes are aligned in a common plane. A power source (306) and a belt (308) are also provided. The belt couples the power source to the sets.

A final embodiment of the system (400) is illustrated in FIG. 12. In this embodiment a plurality of sets (404) of internal and external drums are provided. Each set has associated supports, a drive disc, cones and fluid. The drums of each set have a common axis. The axes are arranged in a circular configuration.

Lastly, a power source (406) in a circular configuration is provided. The power source couples the sets together.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cavitation heater system comprising:

cylindrical interior and exterior drums, each drum having a cylindrical side wall with primary and secondary end caps;

fixed primary and secondary supports, each support having a primary shaft with an interior end fixedly supported by a primary end cap of the interior drum and the exterior end rotatably supported in a support plate;

a drive disc secured to the primary shaft of the primary support for rotation therewith, the drive disc having an angled exterior surface, the primary end cap of the exterior drum having an angled interior surface;

a plurality of cones in contact with the interior and exterior surfaces whereby rotation of the drive disc and the primary shaft and the interior drum will translate into counter rotation of the exterior drum; and a quantity of fluid located between the drums for generating heat in response to the counter rotation of the drums.

2. A cavitation heater system comprising:

cylindrical interior drum having a cylindrical side wall with primary and secondary end caps;

a cylindrical exterior drum having a cylindrical side wall with primary and a secondary end caps;

a fixed primary support having a primary shaft with an interior end fixedly supported by the primary end cap of the interior drum and an exterior end rotatably supported in a support plate;

a fixed secondary support having a secondary shaft with an interior end fixedly supported by the secondary end cap of the interior drum and an exterior end rotatably supported in a support plate;

a drive disc secured to the primary shaft for rotation therewith, the drive disc having an angled exterior surface, the primary end cap of the exterior drum having an angled interior surface;

a plurality of cones in contact with the interior and exterior surfaces whereby rotation of the drive disc and the primary shaft and the interior drum will translate into counter rotation of the exterior drum; and a quantity of fluid located between the drums for generating heat in response to the counter rotation of the drums.

3. The system as set forth in claim 2 wherein the shafts and drums are all rotatable about a common vertically oriented central axis.

4. The system (100) as set forth in claim 2 and further including a plurality of magnets (104) attached to and extending outwardly from the interior drum or inwardly from the exterior drum to increase the turbulence of the fluid for increasing the heating during the counter rotation of the drums.

5. The system (200) as set forth in claim 2 wherein the shafts and drums are all rotatable about a common horizontally oriented central axis and further including a propeller (204) rotatable with wind for rotating the primary shaft and the drums.

6. The system (300) as set forth in claim 2 and further including:

a plurality of sets (304) of internal and external drums, each set having associated supports, a drive disc, cones and fluid, the drums of each set having a common axis, the axes aligned in a common plane;

a power source (306); and a belt (308) coupling the power source to the sets.

7. The system (400) as set forth in claim 2 and further including:

a plurality of sets (404) of internal and external drums, each set having associated supports, a drive disc, cones and fluid, the drums of each set having a common axis, the axes arranged in a circular configuration; and a power source (406) in a circular configuration coupling the sets together.

8. A cavitation heater system 10 for generating heat through the movement of oil caused by the counter rotating movement of cylindrical drums, the system comprising, in combination:

a cylindrical interior drum (14) having a cylindrical side wall (16) with primary and secondary end caps (18) (20) the interior drum having a first diameter and a first axial length;

a cylindrical exterior drum (24) having a cylindrical side wall (26) with primary and secondary end caps (28) (30), the exterior drum having a second diameter greater than the first diameter, the exterior drum having a second axial length greater than the first axial length;

a fixed primary support plate (34), a primary shaft (36) having an interior end fixedly supported by the primary end cap (18) of the interior drum, the primary shaft (36) having an exterior end rotatably supported in the primary support plate (34);

a fixed secondary support plate (40), a secondary shaft (42) having an interior end fixedly supported by the secondary end cap of the interior drum (20), the secondary shaft having an exterior end rotatably supported in the secondary support plate (40);

roller bearings (48) positioned between the primary shaft (36) and the primary end cap (28) of the exterior drum and between the secondary shaft (42) and the secondary end cap (30) of the exterior drum, thrust bearings (50) encompassing the primary shaft (36) between the primary end cap (18) of the interior drum and the primary end cap (28) of the exterior drum, thrust bearing (52) encompassing the secondary shaft (42) between the secondary end cap (20) of the interior drum and the secondary end cap (30) of the exterior drum;

a drive disc (54) secured to the primary shaft (36) for rotation therewith, the drive disc adapted to be operatively coupled to a source of power;

the drive disc (54) having an angled exterior surface (58), the primary end cap (28) of the exterior drum having an angled interior surface (60) facing the exterior surface (58) of the drive disc to create an annular space, a plurality of elastomeric cones (62) in the annular space in contact with the interior surface (60) and the exterior surface (58) whereby rotation of the drive disc and the primary shaft (36) and the interior drum (14) will translate into counter rotation of the exterior drum (24), a cone retaining plate (64) supporting the plurality of cones (62) for rotational movement, the drive disc (54) and the drums (14) (24) having a common vertically oriented central axis;

a plurality of guide pins (68) extending through the primary support plate (34) and axially shiftable with respect thereto, each of the guide pins (68) having an interior end secured to the cone retaining plate (64), the guide pins having exterior ends with a solenoid plate receiving and supporting the exterior ends of the guide pins, a linear solenoid (70) secured to the solenoid plate for axial movement of the guide pins (68) and cones (62) for initiating and terminating the rotation and counter rotation of the drums (14) (24), a retention assembly (72) for positioning the solenoid at a fixed distance from the primary support plate (34);

a quantity of oil (76) located between the interior (14) and exterior (24) drums for generating heat in response to the counter rotation of the drums; and fins (80) secured to and extending radially outwardly from the exterior drum (24) to dissipate heat generated by the oil (76), the fins being arcuately shaped as air moving blades.

* * * * *